US007052598B2

(12) United States Patent
Debuisschert et al.

(10) Patent No.: US 7,052,598 B2
(45) Date of Patent: May 30, 2006

(54) PROCESS FOR THE PRODUCTION OF GASOLINE WITH A LOW SULFUR CONTENT COMPRISING A HYDROGENATION, A FRACTIONATION, A STAGE FOR TRANSFORMATION OF SULFUR-CONTAINING COMPOUNDS AND A DESULFURIZATION

(75) Inventors: Quentin Debuisschert, Rueil Malmaison (FR); Denis Uzio, Marly le Roi (FR); Jean-Luc Nocca, Houston, TX (US); Florent Picard, Saint Symphorien d'Ozon (FR)

(73) Assignees: Institut Francais du Petrole, Rueil Malmaison Cedex (FR); BP Corporation North America, Inc., Warrenville, IL (US)

( * ) Notice: Subject to any disclaimer, the term of this patent is extended or adjusted under 35 U.S.C. 154(b) by 349 days.

(21) Appl. No.: 10/095,295

(22) Filed: Mar. 12, 2002

(65) Prior Publication Data

US 2003/0042175 A1 Mar. 6, 2003

Related U.S. Application Data

(60) Provisional application No. 60/287,389, filed on May 1, 2001, provisional application No. 60/289,812, filed on May 1, 2001, provisional application No. 60/294,594, filed on Jun. 1, 2001.

(30) Foreign Application Priority Data

Mar. 12, 2001 (FR) ..... 01/03.358

(51) Int. Cl.
*C10G 45/00* (2006.01)
*C10G 65/00* (2006.01)

(52) U.S. Cl. ..... 208/213; 208/210; 208/211; 208/212; 208/97

(58) Field of Classification Search ..... 208/88, 208/58, 60, 61, 57, 95, 97, 211, 204, 210, 208/213, 212; 585/259
See application file for complete search history.

(56) References Cited

U.S. PATENT DOCUMENTS 3,733,260 A * 5/1973 Davies et al. ..... 208/212
6,444,118 B1 * 9/2002 Podrebarac et al. ..... 208/210

FOREIGN PATENT DOCUMENTS

| | | |
|---|---|---|
| EP | 0 755 995 | 1/1997 |
| EP | 1 077 247 | 2/2001 |
| EP | 1 138 749 | 10/2001 |
| WO | 94/22980 | 10/1994 |

* cited by examiner

*Primary Examiner*—Walter D. Griffin
(74) *Attorney, Agent, or Firm*—Millen White Zelano & Branigan, P.C.

(57) ABSTRACT

A process for the production of gasoline with a low sulfur content that comprises at least one selective hydrogenation of diolefins, optionally at least one stage for transformation, preferably to increase their weight, for light sulfur-containing compounds that are present in the gasoline, at least one fractionation of the gasoline that is obtained into at least two fractions: light gasoline and heavy gasoline, then optionally a stage for transformation, preferably for alkylation or adsorption, of sulfur-containing compounds and a desulfurization treatment in a stage of at least a portion of the heavy fraction.

18 Claims, 1 Drawing Sheet

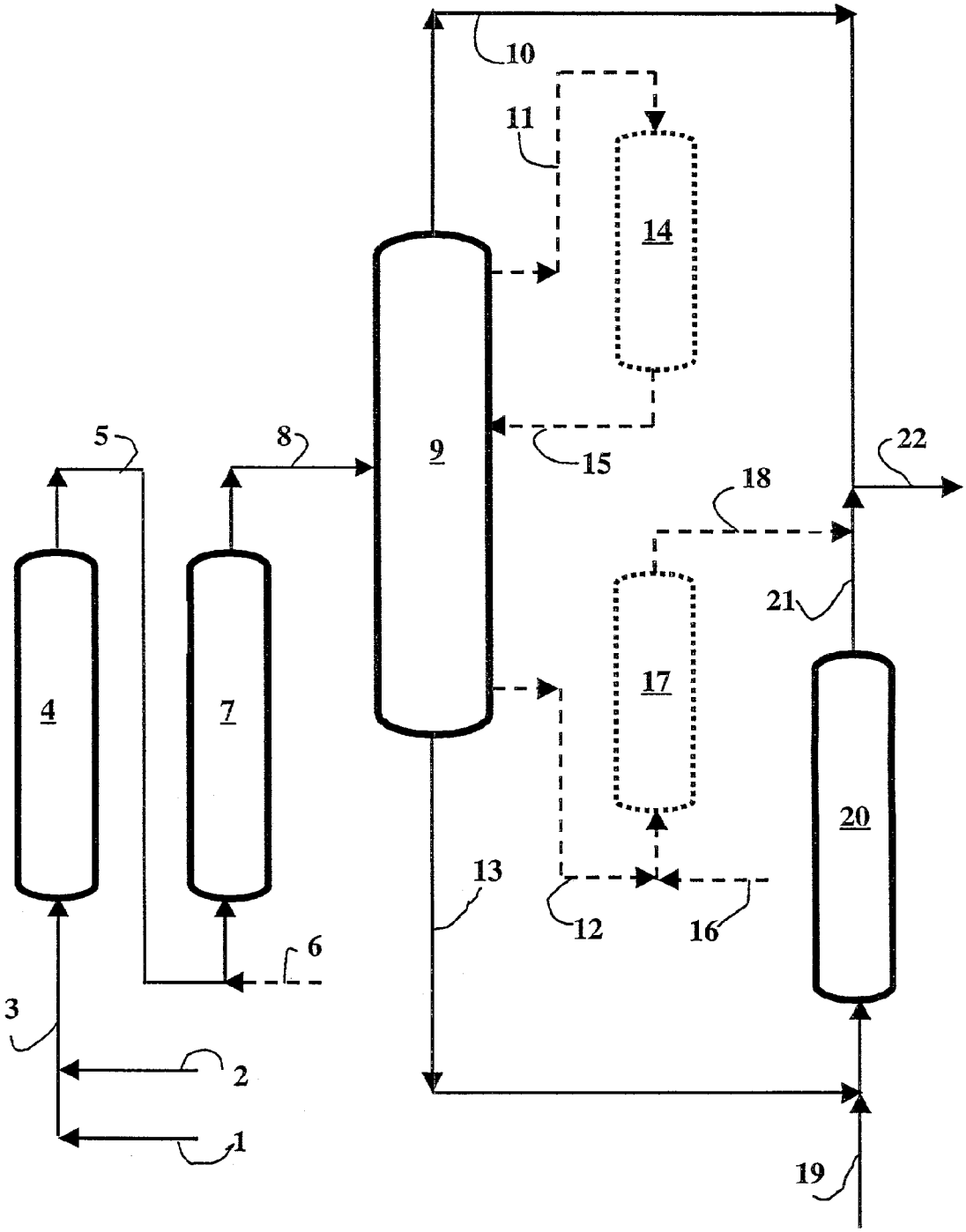
10
11
14
9
15
5
8
22
18
21
4
7
17
20
13
12
16
6
3
2
1
19

PROCESS FOR THE PRODUCTION OF GASOLINE WITH A LOW SULFUR CONTENT COMPRISING A HYDROGENATION, A FRACTIONATION, A STAGE FOR TRANSFORMATION OF SULFUR-CONTAINING COMPOUNDS AND A DESULFURIZATION

CROSS-REFERENCE TO RELATED APPLICATION

This application is entitled to the benefit of U.S. Provisional Application Ser. No. 60/287,389 filed on May 1, 2001, under the provisions of 35 U.S.C. 119(e) and entitled "Process For The Production Of Gasoline With A Low Sulfur Content Comprising A Stage For Transformation Of Sulfur-Containing Compounds, An Acid-Catalyst Treatment And A Desulfurization", based on French Application 01/03.358 filed Mar. 12, 2001 and French Application 01/04.6 18 filed Apr. 4, 2001 and U.S. Provisional Application Ser. No. 60/289,812 filed May 1, 2001, and entitled "Process For The Production Of A Desulfurized Gasoline From A Gasoline Fraction That Contains Conversion Gasoline", based on French Application 01/03.358 filed Mar. 12, 2001 and French Application 01/05.538 filed Apr. 23, 2001, and U.S. Provisional Application Ser. No. 60/294,594 filed Jun. 1, 2001.

The invention relates to a process for the production of gasoline with a low sulfur content that comprises a hydrogenation, a fractionation, a stage for transformation of sulfur-containing compounds and a desulfurization. This process makes it possible to upgrade a gasoline fraction that optionally also comprises hydrocarbons with two, three or four carbon atoms, by reducing the total sulfur content of said fraction to very low levels that are compatible with current or future specifications. This desulfurization is furthermore carried out without an appreciable reduction of the gasoline yield and by minimizing the reduction of the octane number.

PRIOR ART

The production of reformulated gasolines that meet new environmental standards requires in particular that their olefin concentration be reduced slightly but that their concentration in aromatic compounds (mainly benzene) and sulfur be reduced to a significant extent. The catalytic cracking gasolines, which may represent 30 to 50% of the gasoline pool, have high olefin and sulfur contents. The sulfur that is present in the reformulated gasolines can be nearly 90%, attributed to the catalytic cracking gasoline (FCC, "Fluid Catalytic Cracking," or fluidized bed catalytic cracking). The desulfurization (hydrodesulfurization) of gasolines and mainly FCC gasolines is therefore of obvious importance for achieving the specifications.

Hydrotreatment (hydrodesulfurization) of the feedstock that is sent to catalytic cracking produces gasolines that typically contain 100 ppm of sulfur. The hydrotreatment units of catalytic cracking feedstocks operate, however, under severe temperature and pressure conditions, which assumes a significant hydrogen consumption and a high investment. In addition, the entire feedstock should be desulfurized, which involves the treatment of very large volumes of feedstock.

The hydrotreatment (or hydrodesulfurization) of the catalytic cracking gasolines, when it is carried out under standard conditions that are known to one skilled in the art, makes it possible to reduce the sulfur content of the fraction. This process, however, exhibits the major drawback of causing a very significant drop in the octane number of the fraction caused by the saturation of all of the olefins during hydrotreatment.

In contrast, U.S Pat. No. 4,131,537 teaches that it is advantageous to fractionate the gasoline into several fractions, preferably three, as a function of their boiling point, and to desulfurize them under conditions that may be different and in the presence of a catalyst that comprises at least one metal of group VIB and/or of group VIII. This patent indicates that the greatest benefit is obtained when the gasoline is fractionated into three fractions and when the fraction that has intermediate boiling points is treated under mild conditions.

Patent Application EP-A-0 755 995 describes a process for desulfurization of FCC gasolines that comprises at least two stages. The first is a catalytic hydrodesulfurization at a temperature of between 200 and 350° C. with a desulfurization rate of between 60 and 90%, and it is carried out in the presence of a feedstock that contains less than 0.1% by volume of hydrogen sulfide (H2S). The second, thus optionally the subsequent ones, are also catalytic hydrodesulfurization stages that are operated between 200 and 300° C. and in the presence of a feedstock that comprises less than 0.05% by volume of H2S. The desulfurization rate is between 60 and 90% in this stage. In this process, the H2S concentration should be kept at a very low level. In the event of excess hydrogen being recycled, it is therefore in general necessary to eliminate the H2S, for example with an absorption stage with amines, after the second stage and the subsequent ones, so that the recycling gas contains less than 0.1% by volume of H2S. It is also preferred to eliminate the H2S between the first and the second stage to observe the maximum H2S content at the inlet of the second stage (0.05% by volume). For gasolines that are high in sulfur, such an elimination is therefore necessary, taking into account the desulfurization rate that is greater than 60% in the first stage.

Patent Application EP-A-0 725 126 describes a process for hydrodesulfurization of a cracking gasoline in which the gasoline is separated into a number of fractions that comprise at least a first fraction that is rich in compounds that are easy to desulfurize and a second fraction that is rich in compounds that are difficult to desulfurize. Before carrying out this separation, it is necessary to determine in advance the distribution of the sulfur-containing compounds by means of analyses. These analyses are necessary for selecting the equipment and the separation conditions.

In this application, it is thus indicated that the olefin content and the octane number of a light cracking gasoline fraction drop significantly when the fraction is desulfurized without being fractionated. In contrast, the fractionation of said light fraction into 7 to 20 fractions, followed by analyses of the sulfur and olefin contents of these fractions, makes it possible to determine the fraction or fractions that are richest in sulfur-containing compounds, which are then desulfurized simultaneously or separately and mixed with other fractions that may or may not be desulfurized. Such a procedure is complex and should be reproduced at each change in the composition of the gasoline that is to be treated.

French Patent 2 785 908 teaches the advantage of fractionating the gasoline into a light fraction and a heavy fraction and then in carrying out a specific hydrotreatment of the light gasoline on a nickel-based catalyst, and a hydrotreatment of the heavy gasoline on a catalyst that comprises at least one metal of group VIII and/or at least one metal of group VIb.

Processes for hydrotreatment of gasolines that consist in fractionating the gasoline, then in introducing the fractions at different levels of a hydrodesulfurization reactor and in converting the desulfurized fractions on a ZSM-5 zeolite to compensate the octane loss that is recorded with an isomerization, have also been proposed, for example, in Patent U.S. Pat. No. 5,290,427. This isomerization is accompanied by a cracking of the gasoline into lighter compounds.

In these processes, the gasolines that are to be treated in general have a starting point that is greater than 70° C., and there again it is necessary to treat the light gasoline separately (fraction that corresponds to the compounds with boiling points between C5 hydrocarbons with 5 carbon atoms and 70° C.), for example by softening.

U.S. Pat. No. 5,318,690 proposes a process that comprises a gasoline fractionation and a softening of the light gasoline, while the heavy gasoline is desulfurized, then converted on a ZSM-5 zeolite and desulfurized again under mild conditions. This technique is based on a separation of the crude gasoline to obtain a light fraction that is virtually lacking in sulfur-containing compounds other than mercaptans. This makes it possible to treat said fraction only with a softening that removes the mercaptans.

As a result, the olefins that are present in a relatively large amount in the heavy fraction are partly saturated during the hydrotreatment. To compensate for the drop in the octane number that is associated with the hydrogenation of the olefins, the patent recommends cracking on zeolite ZSM-5 which produces olefins, but to the detriment of the yield. In addition, these olefins can recombine with the H2S that is present in the medium for reforming mercaptans. It is then necessary to carry out a softening or an additional hydrodesulfurization.

Patent Application WO 00/15319 describes a process that makes it possible to carry out simultaneously the fractionation and the treatment of a light naphtha. In this process, the light fraction contains mercaptans generally from methylmercaptan to hexyl-mercaptan. These sulfur-containing compounds are eliminated from the light fraction only in the case where the fractionation column contains a hydrodesulfurization section at the top of the column. Without this section, it therefore is not possible to eliminate the mercaptans that either are found in the desulfurized gasoline when the light fraction is recombined with the desulfurized heavy fraction or can be eliminated with the entire light fraction, which brings about a loss of the gasoline yield after desulfurization.

U.S. Pat. No. 6,083,379 describes a process for desulfurization and improvement of the octane number of gasolines that comprises a fractionation of the gasoline into at least two fractions, the treatment of the light fraction in the presence of a zeolite, a fractionation of the light fraction that is thus treated, the mixture of the heavy fractions that are obtained during two fractionation stages, and the hydrodesulfurization of the mixture of these fractions.

Patent Application WO 94/22980 describes a process for desulfurization of gasoline that comprises a fractionation into two fractions, the heaviest fraction is desulfurized in a hydrodesulfurization reactor then treated in the presence of an acid catalyst that makes it possible to compensate for the octane loss. The lightest fraction is also desulfurized with a non-hydrogenating extraction of mercaptans.

U.S. Pat. No. 5,968,346 describes a process for hydroconversion of a hydrocarbon-containing feedstock that makes it possible to remove impurities such as compounds that comprise heteroatoms. This process comprises a first stage for hydroconversion of the entire feedstock, followed by a separation of the liquid and the vapor that are present in the effluent of this first stage and bringing a gas into contact with a liquid. The mixture of the two liquid fractions that are obtained from bringing them into contact and fractionation is then treated in a second hydroconversion stage in the presence of a catalyst.

SUMMARY OF THE INVENTION

This invention relates to a process for the production of gasolines with low sulfur contents, which makes it possible to upgrade the entire gasoline fraction that contains sulfur, preferably a gasoline fraction of catalytic cracking or coking (coking according to English terminology), or pyrolysis, or else visbreaking (according to English terminology), and to reduce the sulfur contents in said gasoline fraction to very low levels, without appreciable reduction of the gasoline yield while minimizing the reduction of the octane number that is caused by the hydrogenation of the olefins. The feedstock of the process according to the invention can also optionally comprise in addition a gasoline fraction, whereby a C4 fraction comprises hydrocarbons with two, three or four carbon atoms.

The process according to the invention is a process for the production of gasoline with a low sulfur content from a gasoline fraction that contains sulfur (starting gasoline). It comprises at least the following stages:

a) at least a selective hydrogenation of diolefins that are present in the starting gasoline.

b) optionally at least one stage for chemical transformation of light sulfur-containing compounds that are present in the gasoline; preferably this chemical transformation is intended to increase weight, i.e., increase the molecular weight of said sulfur-containing compounds, preferably essentially sulfur-containing compounds that have a boiling point that is lower than that of thiophene. This stage optionally can be produced simultaneously to stage a over all or part of the starting gasoline, in the same reactor or a different reactor. It can also be carried out separately over all or part of the gasoline that is hydrogenated at stage a. Finally, it can be carried out simultaneously to fractionation stage c described below. In this stage, the thiophene and the thiophenic compounds undergo little transformation.

c) at least one fractionation of the gasoline that is obtained in stage a or b into at least two fractions, a light fraction that is preferably virtually lacking in sulfur and that contains the lightest olefins of the starting gasoline (light gasoline or light fraction), and a heavy fraction in which preferably the majority of the sulfur-containing compounds that are initially present in the starting gasoline are concentrated (heavy gasoline or fraction). It is also possible to separate the gasoline that is obtained in stage a or b into more than two fractions, i.e., for example, a light fraction, at least one intermediate fraction, and a heavy fraction.

d) optionally a stage for transformation of the sulfur-containing compounds that is different from stage b. This is preferably a stage for alkylation or adsorption of sulfur-containing compounds that are selected from the group that consists of thiophene, thiophenic compounds and mercaptans, preferably the mercaptans that have 1 to 6 carbon atoms that are present in at least one fraction that is obtained in stage c), preferably in the light fraction and/or in at least one intermediate fraction. The mercaptans that are optionally present are either formed in stage a and/or b or are present in the starting gasoline and not converted in stage a and/or b.

e) optionally at least one stage that comprises a desulfurization treatment of at least a portion of at least one intermediate fraction that is obtained from fractionation in stage c or stage d for transformation of sulfur-containing compounds in the presence of at least one hydrodesulfurization catalyst or an absorbent.

f) a desulfurization treatment in one stage of at least a portion of the heavy fraction, obtained from the fractionation in stage c or stage d for transformation of thiophenic compounds and optionally mercaptans, in the presence of at least one hydrodesulfurization catalyst or an absorbent.

g) optionally a mixing stage of the light fraction that is obtained from stage c or d, and optionally at least one intermediate fraction that is obtained from stage c or d or e, with the desulfurized heavy fraction that is obtained from stage f.

Preferably all of the desulfurized heavy gasoline that is obtained from stage f is mixed with the light gasoline that is obtained from stage c or d, without separating the liquid and the gas contained in the heavy gasoline after desulfurization, optionally a simple stripping by a cover gas can be carried out to eliminate the H2S from the totally desulfurized heavy gasoline. In some specific cases, the upgrading of the light gasoline, the desulfurized heavy gasoline, and optionally at least one intermediate gasoline is carried out separately. It is then unnecessary to carry out stage g.

The feedstock of the process according to the invention is a gasoline fraction that contains sulfur, preferably a gasoline fraction that is obtained from a catalytic cracking unit, whose range of boiling points typically extends from approximately the boiling points of hydrocarbons with 2 or 3 carbon atoms (C2 or C3) up to about 250° C., preferably from approximately the boiling points of hydrocarbons with 2 or 3 carbon atoms (C2 or C3) up to about 220° C., more preferably from about the boiling points of hydrocarbons with 5 carbon atoms up to about 220° C. The end point of the gasoline fraction depends on the refinery from which it is obtained and market constraints, but it generally remains within the limits that are indicated above.

DETAILED DESCRIPTION OF THE INVENTION

This invention describes a process that makes it possible to obtain a gasoline that is preferably obtained from a unit for catalytic cracking, coking or visbreaking and that has a limited sulfur content in which the gasoline first undergoes a selective hydrogenation treatment of diolefins, then optionally a stage for transformation of the lightest sulfur-containing compounds of the gasoline that after fractionation should be found in the light gasoline so that they are found essentially in the heavy fraction after the fractionation stage of the process according to the invention. The thus treated gasoline then undergoes a fractionation into at least two fractions. Optionally, at least one fraction that is obtained from the fractionation stage, preferably the light fraction or an intermediate fraction, can be treated in a transformation stage of the sulfur-containing compounds that are selected from the group that consists of thiophene, thiophenic compounds and mercaptans. Said stage is preferably an alkylation or adsorption stage.

The heavy gasoline is treated in a desulfurization section, preferably in the presence of a hydrodesulfurization catalyst or an absorbent. No desulfurization of the light fraction is necessary in the process according to the invention, since the bulk of the sulfur-containing compounds that are initially present in the gasoline are found in the heavy fraction and optionally in the intermediate fraction or fractions after the stages for hydrogenation, for transformation of light sulfur-containing compounds (stage b), for fractionation (stage c), and optionally for transformation of sulfur-containing compounds, in particular thiophenic compounds and optionally mercaptans, in particular residual mercaptans that are uncoverted and/or formed in stages a and b (stage d).

This scheme makes it possible to obtain in fine a desulfurized gasoline that has no significant reduction in the olefin content or the octane number even for high desulfurization rates; and this is so without it being necessary to treat the light gasoline by means of a hydrodesulfurization section or softening section, or to have recourse to processes that make it possible to recover the octane number of the gasoline. Thanks to this process, significant hydrodesulfurization rates are achieved under reasonable operating conditions that are specified below.

The fractionation point of the gasoline is preferably limited so as to prevent the presence of thiophene in the light gasoline. Whereby the latter forms azeotropes with a certain number of hydrocarbons, it will be possible to separate in the light gasoline only the C5 olefins and a small portion of the C6 olefins for fear of entraining too large a thiophene fraction in this fraction. In this case, it is advantageous to add to the process according to the invention a stage d for transformation of thiophene and more generally thiophenic compounds, for example by means of an adsorption section or an alkylation reactor that is coupled to the fractionation section or is integrated in said section according to a detailed embodiment in the description below.

To make it possible to recover a larger fraction of the olefins that are present in the light gasoline while limiting the sulfur content of this fraction without additional treatment, it is preferably proposed to treat the feedstock in stage b and/or stage d under conditions and on catalysts that make it possible to transform the sulfur-containing compounds, preferably the light sulfur-containing compounds, into sulfur-containing compounds that have a higher boiling point and that are found again after the separation, optionally in at least one intermediate fraction or in the heavy gasoline. These intermediate and/or heavy fractions can then be desulfurized.

The sulfur content of the gasoline fractions that are produced by catalytic cracking (FCC) depends on the sulfur content of the feedstock that is treated in the FCC, the presence or absence of a pretreatment of the feedstock of the FCC, as well as the end point of the fraction. Generally, the sulfur contents of the entire gasoline fraction, in particular the ones that are obtained from the FCC, are greater than 100 ppm by weight and most often greater than 500 ppm by weight. For gasolines that have end points that are greater than 200° C., the sulfur contents are often greater than 1,000 ppm by weight, and they can even in some cases reach values on the order of 4,000 to 5,000 ppm by weight.

The process according to the invention applies particularly when high desulfurization rates of the gasoline are required, i.e., when the desulfurized gasoline should contain at most 10% of the sulfur of the starting gasoline and optionally at most 5% and even at most 2% of the sulfur of the starting gasoline that corresponds to desulfurization rates that are greater than 90% and even greater than 95% or 98%.

The process according to the invention comprises at least the following stages:

a) at least one stage that is carried out by running the feedstock, preferably consisting of the entire gasoline fraction, over a catalyst that makes it possible to hydrogenate selectively the diolefins of the gasoline without hydrogenating the olefins.

b) optionally at least one optional stage that consists in running all or part of the starting gasoline or the gasoline that is hydrogenated in stage a, preferably all of the starting gasoline or the gasoline that is hydrogenated in stage a, over a catalyst that makes it possible to transform at least partly the light sulfur-containing compounds (for example: ethylmercaptan, propyl mercaptan) by reaction with all or part of the olefins into heavier sulfur-containing compounds. This stage is preferably carried out simultaneously to stage a by running, for example, the starting gasoline over a catalyst that is able both to hydrogenate the diolefins and to transform the light sulfur-containing compounds, preferably with olefins, into heavier sulfur-containing compounds, or over a separate catalyst but that makes it possible to carry out this transformation in the same reactor as stage a. It is optionally possible to observe in certain types of feedstocks a formation of certain mercaptans at the end of stage a or b, and this formation is probably due to a hydrogenolysis of the disulfides of high molecular weight.

c) at least one stage that aims at separating the starting gasoline into a light gasoline and a heavy gasoline. The fraction point of the light gasoline and the heavy gasoline is determined to limit the sulfur content of the light gasoline and to allow its use in the gasoline pool preferably without additional post-treatment. It is also possible to separate the gasoline that is obtained in stage a or b into more than two fractions, i.e., for example, a light fraction, at least one or even several intermediate fractions and a heavy fraction.

d) optionally a stage for transformation of sulfur-containing compounds, preferably for alkylation or adsorption of the compounds that are selected from the group that consists of the thiophene, the thiophenic compounds and optionally the mercaptans that are present in at least one fraction that is obtained in stage c, preferably in the light fraction and/or in at least one intermediate fraction.

e) optionally at least one stage that comprises a desulfurization treatment of at least a portion of at least one intermediate fraction that is obtained from the fractionation in stage c or stage d for transformation of sulfur-containing compounds, in particular thiophene, thiophenic compounds and optionally mercaptans, in the presence of at least one hydrodesulfurization catalyst or an absorbent. Optionally, a stripping can also be carried out between two zones or reactors of hydrodesulfurization, optionally used to desulfurize said intermediate fraction.

f) a desulfurization treatment in a stage of at least a portion of the heavy fraction that is obtained from the fractionation in stage c or stage d for transformation of sulfur-containing compounds, in particular thiophenic compounds in the presence of at least one hydrodesulfurization catalyst or an absorbent. The heavy gasoline and/or at least one thus desulfurized intermediate gasoline can then optionally be stripped (i.e., a gas stream that preferably contains one or more cover gases is passed through this gasoline) so as to eliminate the H2S that is optionally produced during the desulfurization.

g) optionally a stage for mixing the light fraction that is obtained from stage c or d optionally with at least one intermediate fraction that is obtained from stage c, d or e and with the desulfurized heavy fraction that is obtained from stage f. These fractions can also be upgraded separately without being mixed.

According to a variant of the process according to the invention, it is possible to combine at least one reaction section with the fractionation column. Said reaction section or be sections then operate on at least one fraction that is sampled inside of the fractionation column, and the effluent of the reaction section is sent to the fractionation column. The reaction section or sections thus coupled to the fractionation column of stage c can be selected from the group that consists of the reaction sections of the following stages:

Hydrogenation of diolefins (stage a): when stage b is absent, or when stage a is carried out simultaneously to stage b for transformation of light sulfur-containing compounds.

optionally transformation of light sulfur-containing compounds (optional stage b).

transformation of sulfur-containing compounds such as thiophene, thiophenic compounds and optionally mercaptans (optional stage d).

optionally desulfurization of intermediate fractions (optional stage e).

desulfurization of the heavy fraction (stage f).

Such devices that comprise a fractionation column combined with an external reactor that can be used in the process according to the invention were described, for example, for applications in the field of refining and petrochemistry in Patents U.S. Pat. No. 5,1777,283, U.S. Pat. No. 5,817,227 and U.S. Pat. No. 5,888,355.

According to other variants of the process according to the invention, it is also possible to use a reactive column instead of the fractionation column, i.e., to place at least one of said reaction sections in the fractionation column (reaction section that is inside of the column), preferably in a zone where the reagent concentration is at a maximum. Thus, for example, in the case of stage d for transformation of the thiophenic compounds, the reaction section will preferably be placed in a zone that exhibits the maximum concentration of these compounds. Whereby the light fraction of the gasoline does not require desulfurization treatment, when a desulfurization section is inside of the fractionation column, said reaction section generally will not be placed at the top of the column.

According to a preferred variant of the process according to the invention, the reaction section that is inside of the column is selected from the group that consists of the following reaction sections: hydrogenation (stage a), transformation of light sulfur-containing compounds (optional stage b), transformation of sulfur-containing compounds such as thiophene, thiophenic compounds and optionally mercaptans (optional stage d), desulfurization of intermediate fractions (optional stage e), and desulfurization of the heavy fraction (stage f).

In a very preferred embodiment of the process according to the invention, the reaction section is placed in the middle of the fractionation column, so as to treat the compounds that have intermediate boiling points, i.e., the compounds that can constitute an intermediate fraction and that are recovered alone or with the heavy fraction at the bottom of the column, at the end of the fractionation stage. The heavy fraction is then treated in an external reactor that may or may not be associated with the fractionation column.

Such reactive columns are known to one skilled in the art and have been described in, for example, Patents or Patent Applications U.S. Pat. No. 5,368,691, U.S. Pat. No. 5,523,062, FR 2,737,131, FR 2,737,132, and EP-A-0461 855.

Another variant of the process according to the invention consists both in using a reactive column that comprises at least one reaction section and an external reactor that may or may not be coupled to said column. Such variants are described in, for example, Patent Application WO 00/15319.

The variants that are described above are only illustrations of possible variants of the process according to the invention. The process according to the invention actually can be used by combining reaction sections (stages a, b, d, e or f) either associated with the fractionation column of stage c, or inside of said column, or outside and not coupled to said column in that the effluent of said reaction section or sections is not recycled to the fractionation column.

One of the advantages of the process according to the invention resides in the fact that it is not necessary to desulfurize the light fraction of the gasoline that is obtained from fractionation. The transformation of sulfur-containing compounds and/or thiophenic compounds (stages b and/or d) actually makes it possible to reduce considerably the content of sulfur-containing compounds of the light fraction and optionally at least one intermediate fraction, and generally to recover the bulk of these compounds in the heavy fraction, and optionally in the intermediate fraction or fractions.

Stages b and d are distinguished from one another by the fact that the conversion of the thiophenic compounds is generally less than 60% by weight, and even less than 40% by weight in stage b, while the conversion or adsorption of said compounds is most often greater than 80% by weight, preferably greater than 90% by weight, very preferably greater than 95% by weight in stage d. Stage b actually essentially makes the light mercaptans heavier.

This operation is carried out while maintaining the bulk of the olefins in the light fraction, optionally in at least one intermediate fraction that does not require intensive desulfurization. The content of sulfur-containing compounds of the light fraction that is thus obtained is generally less than 50 ppm, preferably less than 20 ppm, more preferably less than 10 ppm and very preferably less than 5 ppm.

Another advantage resides in the fact that the residual content of sulfur-containing compounds of the desulfurized gasoline by means of the process according to the invention is particularly low and that the octane number is kept at a high level.

The stages of the process according to the invention are described in more detail below.

Hydrogenation of Diolefins (Stage a):

The hydrogenation of the dienes is a stage that makes it possible to eliminate, before hydrodesulfurization, almost all of the dienes that are present in the gasoline fraction that contains the sulfur that is to be treated. It preferably takes place in the first stage (stage a) of the process according to the invention, generally in the presence of a catalyst that comprises at least one metal of group VIII, preferably selected from the group that consists of platinum, palladium and nickel, and a substrate. For example, a nickel-based or palladium-based catalyst that is deposited on an inert substrate, such as, for example, alumina, silica or a substrate that contains at least 50% of alumina, will be used.

The pressure that is used is adequate for maintaining more than 60%, preferably 80%, and more preferably 95% by weight of the gasoline that is to be treated in liquid phase in the reactor; it is most generally between about 0.4 and about 5 MPa and preferably greater than 1 MPa, more preferably between 1 and 4 MPa. The hourly volumetric flow rate of the liquid that is to be treated is between about 1 and about 20 $h^{-1}$ (volume of feedstock per volume of catalyst and per hour), preferably between 2 and 10 $h^{-1}$, very preferably between 3 and 8 $h^{-1}$.

The temperature is most generally between about 50 and about 250° C., and preferably between 80 and 220° C., and more preferably between 100 and 200° C., to ensure a sufficient conversion of diolefins. Very preferably, it is limited to 180° C. The hydrogen to feedstock ratio that is expressed in liters is generally between 1 and 50 liters per liter, preferably between 3 and 30 liters per liter, more preferably between 8 and 25 liters per liter.

The selection of operating conditions is particularly important. The operation most generally will be performed under pressure and in the presence of an amount of hydrogen that slightly exceeds the stoichiometric value that is necessary for hydrogenating the diolefins. The hydrogen and the feedstock that is to be treated are injected in upward or downward flows in a reactor that preferably comprises a fixed catalyst bed.

Another metal can be combined with the main metal to form a bimetallic catalyst, such as, for example, molybdenum or tungsten. The use of such catalytic formulas has been claimed in, for example, Patent FR 2 764 299.

The catalytic cracking gasoline can contain up to several % by weight of diolefins. After hydrogenation, the diolefin content is generally reduced to less than 3000 ppm, and even less than 2500 ppm and more preferably less than 1500 ppm. In some cases, less than 500 ppm can be obtained. The diene content after selective hydrogenation can even, if necessary, be reduced to less than 250 ppm.

According to a particular embodiment of the process according to the invention, the hydrogenation stage of the dienes takes place in a catalytic hydrogenation reactor that comprises a catalytic reaction zone that is traversed by the entire feedstock and the quantity of hydrogen that is necessary to carry out the desired reactions.

Transformation of Light Sulfur Compounds (Stage b):

This optional stage consists in transforming the light sulfur compounds, i.e., the compounds that would be found in the light gasoline at the end of separation stage b, into heavier sulfur-containing compounds that are entrained in the heavy gasoline. The transformed light compounds preferably have a boiling point that is less than that of thiophene. This transformation is preferably carried out on a catalyst that comprises at least one element of group VIII (groups 8, 9 and 10 of the new periodic table) or that comprises a resin. The selection of the catalyst is carried out in particular to promote the reaction between the light mercaptans and the olefins, which produces heavier mercaptans.

This optional stage optionally can be carried out at the same time as stage a. For example, it can be particularly advantageous to operate, during the hydrogenation of the diolefins, under conditions such that at least a portion of the compounds in mercaptan form are transformed. A certain reduction of the mercaptan content thus is obtained. To do this, it is possible to use the procedure for hydrogenating dienes that is described in Patent Application EP-A-0 832 958, which advantageously uses a palladium-based catalyst, or the one that is described in Patent FR 2 720 754.

Another possibility is to use a nickel-based catalyst that is identical to or different from the catalyst of stage a, such as, for example, the catalyst that is recommended in the process of Patent U.S. Pat. No. 3,691,066, which makes it possible to transform the mercaptans (butylmercaptan) into heavier sulfur-containing compounds (sulfides).

Another possibility for carrying out this stage consists in hydrogenating at least partly the thiophene into thiophane whose boiling point is greater than that of thiophene (boiling point 121° C.). This stage can be carried out on a catalyst with a nickel, platinum or palladium base. In this case, the temperatures are generally between 100 and 300° C., and preferably between 150 and 250° C. The H2/feedstock ratio is adjusted between 1 and 20 liters per liter, preferably between 3 and 15 liters per liter, to promote, if possible, in addition the desired hydrogenation of the thiophenic compounds and to reduce the hydrogenation of the olefins that are present in the feedstock. The volumetric flow rate is generally between 1 and 10 $h^{-1}$, preferably between 2 and 4 $h^{-1}$, and the pressure is between 0.5 and 5 MPa, preferably between 1 and 3 MPa.

Separation of Gasoline into At Least Two Fractions (Stage c):

According to a first variant of the process according to the invention, the gasoline is fractionated into two fractions:

- a light fraction that contains a limited residual sulfur content, preferably less than about 200 ppm, more preferably less than 100 ppm, very preferably less than about 20 ppm, that makes it possible to use this fraction without carrying out other treatment that aims at reducing its sulfur content, except optional stage d for treatment of thiophene and/or thiophenic compounds.
- a heavy fraction in which the bulk of the sulfur that is initially present in the feedstock is preferably concentrated.

This separation is preferably carried out by means of a standard distillation column that is also called a splitter. This fractionation column should make it possible to separate a light fraction of the gasoline that contains a small fraction of sulfur and a heavy fraction that preferably contains the bulk of the sulfur that was initially present in the starting gasoline.

This column generally operates at a pressure of between 0.1 and 2 MPa and preferably between 0.2 and 1 MPa. The number of theoretical plateaus of this separation column is generally between 10 and 100 and preferably between 20 and 60. The reflux rate, which is expressed as being the ratio of the liquid flow rate in the column that is divided by the flow of distillate, expressed in kg/h, is generally less than the unit and preferably less than 0.8.

The light gasoline that is obtained at the end of the separation generally contains at least all of the C5 olefins, preferably the C5 compounds and at least 20% of the C6 olefins. Generally, this light fraction has a low sulfur content, i.e., it is generally unnecessary to treat the light fraction before using it as a fuel.

According to a second variant of the process according to the invention, the gasoline is fractionated into at least 3 fractions: a light fraction, a heavy fraction and at least one intermediate fraction.

In the case where stage d for transformation of sulfur-containing compounds, in particular thiophenic compounds, is present in the process according to the invention, the gasoline is preferably fractionated into at least two fractions that exhibit the following properties:

- a so-called light fraction (fraction L) whose boiling points are preferably less than about 60° C. This temperature is given by way of example; it is, in fact, the maximum temperature for which the thiophene content is less than 5 ppm,
- at least one so-called heavy fraction (fraction H1), whose boiling points are (by way of example) greater than about 60° C.

Light fraction L is preferably injected into a flask for gas-liquid separation to separate the unconsumed hydrogen and H2S, formed during stage a and/or b, whereby olefins generally have 5 to 7 carbon atoms.

So-called heavy fraction H1, i.e., the fraction whose temperatures are greater than about 60° C., is sent into a distillation column or any other separation process that can separate this fraction into at least two fractions:

- intermediate fraction 12 whose boiling points by way of example are at least 60° C. and at most about 120° C. and even about 160° C. This fraction can be treated in stage d of the process according to the invention.
- a heavier fraction H2 whose boiling points are generally greater than about 160° C. or about 120° C.

Heavy fraction H2 whose boiling temperatures are generally greater than about 160° C. or about 120° C. is sent to stage f) for desulfurization.

In another version of the process according to the invention, it is also possible to fractionate the gasoline directly into at least three fractions: a light fraction (L), at least one intermediate fraction (I2), and at least one heavy fraction (H2) that exhibits the properties that are described above.

Intermediate fraction I2 whose boiling points are between, by way of example, about 60° C. and about 120° C. or about 160° C. can be sent into a transformation unit of sulfur-containing compounds according to stage d.

After stage d, fractions I2 can again be fractionated into an intermediate fraction I3 and a heavy fraction H3, in particular when stage d is a stage for alkylation of the thiophenic compounds. Fraction H3 that is thus obtained can optionally be mixed with fraction H2, preferably before to desulfurization.

Transformation of Sulfur-Containing Compounds, In Particular Thiophenic Compounds, Preferably by Alkylation or Adsorption (Stage d):

Stage d is a stage for transformation of sulfur-containing compounds that are selected from the group that consists of the thiophene, the thiophenic compounds and the mercaptans that are present in the light fraction and/or in at least one intermediate fraction.

This stage consists in preferably running the light fraction and/or optionally at least one intermediate fraction that is obtained from the fractionation (stage c) over an absorbent or over a catalyst that has an acid function that makes it possible to carry out the addition of sulfur-containing compounds in the form of mercaptans over olefins and the alkylation reaction of thiophene and thiophenic derivatives by these same olefins. The operating conditions are adjusted to carry out the desired transformation with rates of conversion or adsorption of thiophene and/or thiophenic compounds and/or light mercaptans, preferably mercaptans that have 1 to 6 carbon atoms, greater than 80% by weight, preferably greater than 90% by weight, very preferably greater than 95% by weight. Other compounds such as COS or CS2 can optionally also be adsorbed or converted.

To reduce the oligomerizing activity of the acid catalyst that is optionally used, the gasoline can be supplemented with a known compound for inhibiting the oligomerizing activity of the acid catalysts, such as the alcohols, ethers or water.

This transformation can be performed, for example, according to the procedures and by using the diagrams that are described in French Patent Applications No. 00/08113 and No. 00/10233 for stages a to d of the process according to the invention or by combining stages a to c of the process according to the invention and as described above with stage d presented in detail as follows.

When this optional stage is present in the process according to the invention, the light fraction or the intermediate fraction obtained in stage c is treated in a section that makes it possible to transform, preferably by alkylation or adsorption, the compounds that are selected from the group that consists of thiophene, thiophenic compounds and mercaptans. In the case of an alkylation, the thiophenic compounds that are contained in the fraction at 60° C.–160° C. will react with conversion rates that are higher than 80% by weight, preferably higher than 90% by weight, with olefins to form thiophene alkyls according to the following reaction for thiophene:

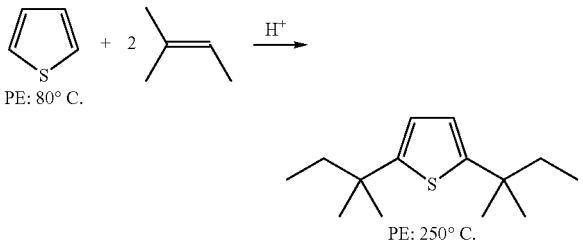

A portion or all of the benzene can also be eliminated by alkylation with the olefins. These compounds of higher molecular weight are primarily characterized by higher boiling points than those that they had before alkylation. Thus, the theoretical boiling point, which is 80° C., is shifted toward 250° C. for the thiophene alkyls, and this reaction therefore most often results in rendering the gasoline heavier, in particular in the case where the gasoline fraction and/or the starting gasoline are light.

This alkylation stage is carried out in the presence of acid catalyst. This catalyst can be equally a resin, a zeolite, a clay, any silica that is functionalized or any silico-aluminate that has an acidity, or any grafted substrate of acid functional groups. The ratio of the injected feedstock volume to the catalyst volume is between 0.1 and 10 liters/liter/hour and preferably between 0.5 and 4 liters/liter/hour. More specifically, this alkylation stage is carried out in the presence of at least one acid catalyst that is selected from the group that consists of silicoaluminates, titanosilicates, mixed alumina-titanium compounds, clays, resins, mixed oxides obtained by grafting at least one organometallic compound that is organosoluble or water-soluble (selected from the group that consists of alkys, and/or alkoxy metals of at least one element such as titanium, zirconium, silicon, germanium, tin, tantalum, niobium . . . ) on at least one oxide such as alumina (gamma, delta, eta forms, alone or mixed), silica, alumina silicas, titanium silicas, zirconium silicas or any other solid that has any acidity. A particular embodiment of the invention can consist in using a physical mixture of at least two of the catalysts above in proportions that vary from 95/5 to 5/95, preferably from 85/15 to 15/85 and very preferably from 70/30 to 30/70.

The temperature for this stage is generally between 10 and 350° C. according to the type of catalyst or the force of the acidity. Thus, for an ion-exchanger-type acid resin, the temperature is between 50 and 150° C., preferably between 50 and 120° C.

The molar ratio of olefin to thiophenic compounds is between 0.1 and 1000 mol/mol, preferably between 0.5 and 500 mol/mol.

The operating pressure of this stage is generally between 0.1 and 3 MPa and preferably such that the feedstock is in liquid form under the temperature and pressure conditions, or at a pressure that is higher than 0.5 MPa.

The effluent that is obtained from stage d, for transformation of sulfur-containing compounds, preferably for alkylation or adsorption, can optionally be mixed at least partly with a heavy fraction that is obtained from the fractionation in stage c.

The effluent that is obtained from stage d for transformation of the sulfur-containing compounds can also optionally be sent into a new fractionation unit for being separated into two fractions, an intermediate fraction that is not treated or is optionally desulfurized without being mixed, and a heavy fraction that is preferably mixed with the heavy fraction that is obtained from stage d before being desulfurized in stage f.

For example, effluent D1 that is obtained from an alkylation can be separated into:

- a fraction at 60° C.–180° C. or 60° C.–100° C. (fraction D2) that is collected and is lacking in any thiophenic compound,
- a fraction whose boiling points are higher than 180° C. or 100° C. (fraction D3).

When it is an alkylation, stage d can optionally be advantageously operated on the light fraction that is obtained from stage c. Actually, the alkylation of the light mercaptans that are present in this fraction then facilitates the desired elimination of the sulfur-containing compounds, but also makes it possible to reduce the vapor pressure (RVP index or Reid Vapor Pressure according to English terminology) of the final desulfurized gasoline.

The entire effluent D1 that is obtained from said alkylation unit (stage d) or fraction D3 that is obtained from the fractionation after alkylation can preferably be mixed at least partly with a heavy fraction (for example the H2 fraction) and sent into the desulfurization section of stage f.

Desulfurization of the Heavy Fraction (Stage f) and Optionally At Least One Intermediate Fraction (Stage e):

This stage can be, for example, a hydrodesulfurization stage that is carried out by running heavy gasoline or intermediate gasoline, in the presence of hydrogen, over a catalyst that comprises at least one element of group VIII and/or at least one element of group VIb at least partly in sulfide form at a temperature of between about 210° C. and about 350° C., preferably between 220° C. and 320° C., under a pressure that is generally between about 1 and about 4 MPa, preferably between 1.5 and 3 MPa. The volumetric flow rate of the liquid is between about 1 and about 20 $h^{-1}$ (expressed by volume of liquid per volume of catalyst and per hour), preferably between 1 and 10 $h^{-1}$, very preferably between 3 and 8 $h^{-1}$. The $H_2$/HC ratio is between 100 to 600 liters per liter and preferably between 300 and 600 liters per liter.

The metal content of group VIII that is expressed in oxide is generally between 0.5 and 15% by weight, preferably between 1 and 10% by weight. The metal content of group VIb is generally between 1.5 and 60% by weight, preferably between 3 and 50% by weight.

The element of group VIII, when it is present, is preferably cobalt, and the element of group VIb, when it is present, is generally molybdenum or tungsten. Combinations such as cobalt-molybdenum are preferred. The substrate of the catalyst is usually a porous solid, such as, for example, an alumina, a silica-alumina or other porous solids, such as, for example, magnesia, silica or titanium oxide, alone or mixed with alumina or silica-alumina. To reduce the hydrogenation of the olefins that are present in the heavy gasoline, it is advantageous to use, preferably, a catalyst in which the molybdenum density, expressed in % by weight of MoO3 per unit of surface area, is greater than 0.07 and preferably greater than 0.10. The catalyst according to the invention preferably has a specific surface area that is less than 190 m2/g, more preferably less than 180 m2/g, and very preferably less than 150 m2/g.

After introduction of the element or elements and optionally after the catalyst is shaped (when this stage is carried out on a mixture that already contains the basic elements), the catalyst is in a first activated stage. This activation may correspond either to an oxidation, then to a reduction, or to a direct ho reduction or to a calcination alone. The calcination stage is generally carried out at temperatures of from about 100 to about 600° C. and preferably between 200 and 450° C. under an air flow. The reduction stage is carried out under conditions that make it possible to convert at least a portion of the oxidized forms of base metal into metal. It generally consists in treating the catalyst under a hydrogen flow at a temperature that is preferably at least equal to 300° C. The reduction can also be carried out partly with chemical reducing agents.

The catalyst is preferably used at least in part in its sulfurized form. The introduction of the sulfur can take effect before or after every activation stage, i.e., calcination or reduction stage. Preferably, no oxidation stage of the catalyst is carried out when the sulfur or a sulfur-containing compound has been introduced onto the catalyst. The sulfur or a sulfur-containing compound can be introduced ex situ, i.e., apart from the reactor where the process according to the invention is carried out, or in situ, i.e., in the reactor that is used for the process according to the invention. In the latter case, the catalyst is preferably reduced under the conditions that are described above, then sulfurized by passage of a feedstock that contains at least one sulfur-containing compound, which, once decomposed, results in the attachment of sulfur to the catalyst. This feedstock can be gaseous or liquid, for example hydrogen do that contains $H_2S$, or a liquid that contains at least one sulfur-containing compound.

In a preferred way, the sulfur-containing compound is added to the catalyst ex situ. For example, after the calcination stage, a sulfur-containing compound can be introduced into the catalyst optionally in the presence of another compound. The catalyst is then dried, and transferred into the reactor that is used to implement the process according to the invention. In this reactor, the catalyst is then treated under hydrogen to transform at least a portion of the main metal into sulfide. A procedure that is especially suitable to the invention is the one that is described in Patents FR-B-2 708 596 and FR-B-2 708 597.

The desulfurization of the heavy gasoline and/or at least one intermediate gasoline can also be carried out by means of an absorber that comprises an absorbent mass, for example with a zinc oxide base. Said desulfurization can also be carried out by means of a combination between a hydrodesulfurization section and an absorber, preferably located after the hydrodesulfurization section.

As far as the heavy gasoline is concerned, the desulfurization section preferably comprises only a single absorber and/or a single reactor. Said reactor contains only a single type (in terms of chemical formulation) of hydrodesulfurization catalyst, optionally placed in several separate beds. Said catalyst preferably has a cobalt base; in a preferred manner it is a catalyst that comprises cobalt and molybdenum or tungsten. The catalyst that is used in this section is preferably sulfurized.

In contrast, the optional section for treatment of at least one intermediate fraction can comprise several reactors that are optionally associated with one or more absorbers. Said section can comprise two reactors in series, optionally with a separation of the gas that contains H2S and liquid between the two reactors. It is also possible to use two different catalysts that are placed in at least two beds inside of said reactors, optionally with an intermediate hydrogen addition (also called quench according to English terminology). For example, it is possible to use a catalyst that comprises cobalt and molybdenum or tungsten associated with a catalyst that comprises nickel. Said catalysts are preferably sulfurized.

FIG. 1 illustrates certain preferred variants of the process according to the invention. In all of these variants, the feedstock is admitted via pipe 1 and mixed with the hydrogen that arrives via pipe 2. Mixture 3 is introduced into reactor 4 that contains a selective hydrogenation catalyst of diolefins (stage a). The effluent that is obtained from this reactor is introduced into a reactor 7, optionally after the addition of hydrogen via pipe 6. Reactor 7 contains a catalyst that makes it possible to increase weight of the light sulfur-containing compounds, such as the light mercaptans, by reaction with the olefins (stage b). Effluent 8 that is obtained from reactor 7 is introduced into a fractionation column (9) that makes it possible to carry out a separation of the gasoline into at least 2 fractions: a light fraction 10 that is not treated, and a heavy fraction 13 that is desulfurized in a reactor 20 that contains a hydrodesulfurization catalyst, after mixing with the hydrogen that is conveyed via pipe 19. Desulfurized heavy fraction 21 is mixed with light fraction 10 to result in desulfurized gasoline 22.

According to another variant that is described by FIG. 1, fractionation column 9 makes it possible to carry out a separation of effluent 8 from reactor 7 into 4 fractions: an untreated light fraction 10, a first intermediate fraction 11 that is introduced into an alkylation reactor 14 that makes it possible to carry out the alkylation of the thiophene, thiophenic compounds and optionally mercaptans, and whose effluent is sent into fractionation column 9 via line 15, a second intermediate fraction 12 that is treated in the presence of hydrogen that is conveyed via line 16 into a reactor that contains a hydrodesulfurization catalyst, and a heavy fraction 13 that is also desulfurized in the presence of hydrogen that is conveyed via line 19 into a reactor 20 that contains a hydrodesulfurization catalyst. Desulfurized heavy fraction 21 and desulfurized intermediate fraction 18 are mixed with light fraction 10 to produce desulfurized gasoline 22.

In short, according to a variant, the process according to the invention is a process for the production of gasoline with a low sulfur content that comprises at least the following stages: at least one selective hydrogenation of diolefins that are present in the starting gasoline (stage a), at least one stage for transformation of light sulfur-containing compounds that are present in the gasoline (stage b), at least one fractionation (stage c) of the gasoline that is obtained in stage a or b into at least two fractions: a light reaction and a heavy fraction, a desulfurization treatment of one stage (stage f) of at least a portion of the heavy fraction that is obtained from the fractionation in stage c.

According to another variant, the process according to the invention is a process for the production of gasoline with a low sulfur content that comprises at least the following stages: at least one selective hydrogenation of the diolefins that are present in the starting gasoline (stage a), at least one fractionation (stage c) of the gasoline that is obtained in stage a into at least two fractions: a light fraction and a heavy fraction, a stage (stage d) for transformation of the sulfur-containing compounds that are selected from the group that consists of the thiophene, the thiophenic compounds and the mercaptans that are present in at least one fraction that is obtained in stage c, a desulfurization treatment in one stage (stage f) of at least a portion of the heavy fraction that is obtained from fractionation in stage c. In this case, it can also comprise at least one stage for transformation of light sulfur-containing compounds that are present in the gasoline (stage b).

According to a preferred variant of the process according to the invention, stages a and b are carried out simultaneously in the same reactor.

Stages b and/or d preferably make it possible to increase the molecular weight of the sulfur-containing compounds to separate them for the most part in the heavy fraction of stage c.

According to a variant, the gasoline that is obtained from stages a or b can also be fractionated into a light fraction, at least one intermediate fraction and a heavy fraction. In this case, the process according to the invention can also comprise at least one stage d for transformation of sulfur-containing compounds that are selected from the group that consists of the thiophene, the thiophenic compounds and the mercaptans that are present in the light fraction and/or in at least one intermediate fraction.

Stage d for transformation of sulfur-containing compounds is preferably an alkylation or an adsorption.

The process according to the invention can also comprise a stage e for desulfurization of at least a portion of at least one intermediate fraction that is obtained from the fractionation in stage c or stage d for transformation of the sulfur-containing compounds.

The heavy gasoline is preferably desulfurized in stage f in the presence of a hydrodesulfurization catalyst or an absorbent, and more preferably the desulfurized heavy gasoline in stage f is stripped by means of a cover gas.

The process according to the invention can also comprise a stage g for mixing the light fraction that is obtained from stage c or d and optionally at least one intermediate fraction that is obtained from stage c or d or e with the desulfurized heavy fraction that is obtained from stage f.

According to a preferred variant, the process according to the invention comprises at least one reaction section that is inside of the column and selected from the group that consists of the following reaction sections: hydrogenation (stage a), transformation of light sulfur-containing compounds (optional stage b), transformation of sulfur-containing compounds that are selected from the group that consists of thiophene, thiophenic compounds and mercaptans (optional stage d), desulfurization of intermediate fractions (optional stage e) and desulfurization of the heavy fraction (stage f).

According to another preferred variant, at least one reaction section of the process according to the invention is coupled to the column and selected from the group that consists of the following reaction sections: hydrogenation (stage a), transformation of light sulfur-containing compounds (optional stage b), transformation of sulfur-containing compounds that are selected from the group that consists of thiophene, thiophenic compounds and mercaptans (optional stage d), desulfurization of intermediate fractions (optional stage e), and desulfurization of the heavy fraction (stage f).

The effluent that is obtained from stage d for transformation of sulfur-containing compounds can optionally be mixed at least in part with a heavy fraction that is obtained from the fractionation in stage c. Said effluent can also be sent into a new fractionation unit to be separated into two fractions: one intermediate fraction that is untreated or optionally desulfurized without being mixed, and one heavy fraction that is preferably mixed with the heavy fraction that is obtained from stage c before being desulfurized in stage f.

THE FOLLOWING EXAMPLES ILLUSTRATE THE INVENTION

Example 1

A catalytic cracking gasoline whose characteristics are presented in Table 1 is separated into two fractions (stage c): a light fraction whose fraction point corresponds to a temperature of 63° C. and a heavy fraction. The light fraction represents 25% by weight of the starting gasoline and combines 88% of the olefinic compounds that have 5 carbon atoms that were present in the starting gasoline and 23% of the olefins that have 6 carbon atoms.

The characteristics of the separation column are as follows: 30 theoretical plateaus, pressure in the reflux flask=5 MPa, feed temperature 100° C.

The characteristics of the light fraction and the heavy fraction are presented in Table 1.

| | Catalytic Cracking Gasoline | | |
|---|---|---|---|
| | Total Gasoline | Light Fraction PI-63 | Heavy Fraction 63–220° C. |
| REFRACTION INDEX AT 20° C. | 1.43 | 1.38 | 1.45 |
| DENSITY 15/4 | 0.76 | 0.67 | 0.79 |
| IBr (g/100 g) | 78 | 166 | 48 |
| MAV (mg/g) | 6.4 | 5.2 | 6.8 |
| TOTAL NITROGEN (mg/l) | 40 | 2.7 | 50 |
| RON | 93.0 | 95.8 | 92.0 |
| MON | 80.3 | 84.1 | 78.9 |
| SULFUR, NOT MERCAPTANS (mg/Kg) | 1509 | 37 | 2000 |
| MERCAPTANS (mg/kg) | 58 | 158 | 24 |
| TOTAL SULFUR (mg/Kg) | 1567 | 195 | 2024 |

At the end of this separation, the light fraction has a content of sulfur, mercaptan and diolefin such that it is no longer necessary to carry out an additional treatment of this fraction before using it.

The heavy fraction is subjected to hydrodesulfurization on a catalyst in an isothermal tubular reactor. The catalyst is obtained by impregnation "without excess solution" of a transition alumina that comes in the form of balls with a specific surface area of 130 m2/g and a pore volume of 0.9 ml/g, by an aqueous solution that contains molybdenum and cobalt in the form of ammonium heptamolybdate and cobalt nitrate. The catalyst is then dried and calcined under air at 500° C. The content of cobalt and molybdenum of this sample of catalyst A is 3% of CoO and 14% of MoO3. The catalyst is first sulfurized by treatment for 4 hours under a pressure of 3.4 MPa at 350° C., with contact of a feedstock that contains 2% by weight of S in the form of dilute dimethyl disulfide in n-heptane.

The operating conditions of the desulfurization are as follows: VVH=4h−1, $H_2$/HC=300 l/l, P=2 MPa. The temperature of the reaction zone is 280° C. The characteristics of the effluents that are obtained are presented in Table 2.

TABLE 2

Characteristics of the Heavy Gasoline after Hydrodesulfurization

| | Heavy Gasoline | Desulfurized Heavy Gasoline |
|---|---|---|
| S total (ppm) | 2024 | 182 |
| S RSH (ppm) | 24 | 80 |
| Ibr gBr/100 g | 48 | 33 |
| RON | 92.0 | 86.5 |
| MON | 78.9 | 75.8 |
| $H_2S$ (% by volume) | | 0.2 |

The desulfurized heavy gasoline is then mixed with the light gasoline whose composition is given in Table 1. The thus constituted gasoline contains 185 ppm of sulfur including 100 ppm of mercaptans. Such a gasoline will therefore require an additional treatment before its use.

Example 2 (According to the Invention)

The gasoline whose characteristics are described in Example 1 is subjected to a hydrogenation treatment of diolefins (stage a) under conditions where the light sulfur-containing compounds that are present in the feedstock are partly converted into heavier compounds (stage b carried out simultaneously to stage a).

This treatment is carried out in a reactor that operates continuously and with an upward flow. The catalyst is a catalyst HR945 that is marketed by the Procatalyse Company. The reaction is carried out at 160° C. under a total pressure of 13 bar, with a volumetric flow rate of 6 $h^{-1}$. The H2/feedstock ratio, expressed in liter of hydrogen per liter of feedstock, is 10.

The characteristics of the effluent after hydrogenation of the diolefins and conversion of the light compounds that are present in the gasoline are presented in Table 3.

| | Catalytic Cracking Gasoline | |
|---|---|---|
| | Total Gasoline | Gasoline after Treatment |
| REFRACTTON INDEX AT 20° C. | 1.44 | 1.43 |
| DENSITY 15/4 | 0.78 | 0.77 |
| IBr (g/100 g) | 78 | 75.5 |
| MAV (mg/g) | 6.4 | 0.2 |
| TOTAL NITROGEN (mg/l) | 40 | 40 |
| RON | 93.0 | 92.2 |
| MON | 80.3 | 79.9 |
| SULFUR, NOT MERCAPTANS (mg/Kg) | 1509 | 1561 |
| MERCAPTANS (mg/kg) | 58 | 6 |
| TOTAL SULFUR (mg/Kg) | 1567 | 1567 |

At the end of this treatment, the gasoline is separated into two fractions (stage c) under the conditions that are described in Example 1. The characteristics of the two fractions that are obtained are specified in Table 4.

TABLE 4

Characteristics of the Light and Heavy Fractions After Fractionation (Stage c)

| | Catalytic Cracking Gasoline | | |
|---|---|---|---|
| | Total Gasoline | Light Fraction PI-63 | Heavy Fraction 63–220° C. |
| REFRACTION INDEX AT 20° C. | 1.44 | 1.38 | 1.45 |
| DENSITY 15/4 | 0.78 | 0.67 | 0.79 |
| IBr (g/100 g) | 75.5 | 158 | 48 |
| MAV (mg/g) | 0.2 | 0.0 | 0.3 |
| TOTAL NITROGEN (mg/l) | 40 | 2.7 | 50 |
| RON | 92.2 | 92.8 | 92.0 |
| MON | 79.9 | 82.9 | 78.9 |
| SULFUR, NOT MERCAPTANS (mg/Kg) | 1561 | 31 | 2071 |
| MERCAPTANS (mg/kg) | 6 | 2 | 7 |
| TOTAL SULFUR (mg/Kg) | 1567 | 33 | 2078 |

At the end of this separation, the light fraction contains a content of sulfur, mercaptan and diolefin such that it is no longer necessary to carry out an additional treatment of this fraction before using it.

The heavy fraction is subjected to hydrodesulfurization on catalyst A of Example 1 in an isothermal tubular reactor. The catalyst is first sulfurized by treatment for 4 hours under a pressure of 3.4 MPa at 350° C., with contact of a feedstock that contains 2% by weight of S in the form of dilute dimethyl sulfide in n-heptane.

The operating conditions of the desulfurization are as follows: VVH=4h−1, $H_2$/HC=300 l/l, P=2 MPa. The temperature of the reaction zone is 280° C. The characteristics of the effluents that are obtained are presented in Table 5.

TABLE 5

Characteristics of the Heavy Gasoline after Hydrodesulfurization

| | Heavy Gasoline | Desulfurized Heavy Gasoline |
|---|---|---|
| S total (ppm) | 2078 | 185 |
| S RSH (ppm) | 7 | 90 |
| Ibr gBr/100 g | 48 | 33 |
| RON | 92.0 | 86.5 |
| MON | 78.9 | 75.8 |
| $H_2S$ (% by volume) | | 0.2 |

The desulfurized heavy gasoline is then mixed with the untreated light gasoline whose composition is given in Table 4. The thus constituted desulfurized gasoline contains 147 ppm of sulfur including 68 ppm of mercaptans.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 01/03.358, and U.S. Provisional Application No. 60/287,389, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

The invention claimed is:

1. A process for the production of gasoline with a low sulfur content, comprising at least (a) at least one selective hydrogenation of diolefins that are present in starting gasoline (b), at least one transformation of light sulfur-containing compounds that are present in the starting gasoline,(c), at least one fractionation of gasoline that is obtained in (a) or (b) into at least two fractions: a light fraction and a heavy fraction, (d) at least one transformation of sulfur-containing compounds that are selected from the group consisting of thiophene, thiophenic compounds and mercaptans that are present in the light fraction and/or in at least one intermediate fraction, wherein the effluent of (d) is (i) mixed at least in part with a heavy fraction that is obtained from the fractionation in (c);

(ii) sent into a new fractionation unit to be separated into two fractions: an intermediate fraction that is not treated or optionally desulfurized without being mixed, and a heavy fraction that is optionally mixed with the heavy fraction that is obtained from (c) before being desulfurized in stage (f); or (iii) returned to fractionation (c);

(e) optionally desulfurizing at least a portion at least one intermediate fraction obtained from (c) or (d), (f), a one stage desulfurization treatment of at least a portion of the heavy fraction that is obtained from fractionation in (c) stage c.

2. A process according to claim 1, in which (a) and (b) are carried out simultaneously in the same reactor.

3. A process according to claim 1, in which stage b and/or d makes it possible to increase the molecular weight of said sulfur-containing compounds.

4. A process according to claim 1, in which the gasoline that is obtained from stages a or b is fractionated into alight fraction, at least one intermediate fraction and a heavy fraction.

5. A process according to claim 4, further comprising e for desulfurization of at least a portion of at least one intermediate fraction obtained from the fractionation in stage c or stage d for transformation of sulfur-containing compounds.

6. A process according to claim 4, in which the heavy gasoline is desulfurized in stage f in the presence of a hydrodesulfurization catalyst or an absorbent.

7. A process according to claim 4, in which stage d for transformation of sulfur-containing compounds is an alkylation or an adsorption.

8. A process according to claim 1, in which the desulfurized heavy gasoline in stage f is stripped by means of a stripping gas.

9. A process according to claim 1, further comprising a stage g for mixing the light fraction that is obtained from stage c or d and optionally at least one intermediate fraction that is obtained from stage c or d or e with the desulfurized heavy fraction that is obtained from stage f.

10. A process according to claim 1, in which at least one reaction zone is inside of a fractionation column and is selected from the group that consists of the following reactions: hydrogenation (stage a), transformation of light sulfur-containing compounds (optional stage b), transformation of sulfur-containing compounds that are selected from the group that consists of thiophene, thiophenic compounds, and mercaptans (optional stage d), desulfurization of intermediate fractions (optional stage e) and desulfurization of the heavy fraction (stage f).

11. A process according to claim 1, in which at least one reaction zone is coupled to a fractionating column and is selected from the group that consists of the following reactions: hydrogenation (stage a), transformation of light sulfur-containing compounds (optional stage b), transformation of sulfur-containing compounds that are selected from the group that consists of thiophene, thiophenic compounds and mercaptans (optional stage d), desulfurization of intermediate fractions (optional stage e) and desulfurization of the heavy fraction (stage f).

12. A process according to claim 1, in which the effluent that is obtained from stage d for transformation of sulfur-containing compounds is mixed at least in part with a heavy fraction that is obtained from the fractionation in stage c.

13. A process according to claim 1, in which the effluent that is obtained from stage d for transformation of sulfur-containing compounds is sent into a new fractionation unit to be separated into two fractions: an intermediate fraction that is not treated or optionally desulfurized without being mixed, and a heavy fraction that is preferably mixed with the heavy fraction that is obtained from stage c before being desulfurized in stage f.

14. A process according to claim 13, wherein the heavy fraction is mixed with the heavy fraction that is obtained from stage c before being desulfurized in stage f.

15. A process for the production of gasoline with a low sulfur content, comprising at least (a): at least one selective hydrogenation of diolefins that are present in starting gasoline, (c), at least one fractionation of gasoline that is obtained in (a) into at least two fractions: a light fraction and a heavy fraction, (d) transformation of sulfur-containing compounds that are selected from the group consisting of the thiophene, thiophenic compounds and mercaptans, that are present in at least one fraction that is obtained in (c), wherein the effluent of (d) is (i) mixed at least in part with a heavy fraction that is obtained from the fractionation in (c);

(ii) sent into a new fractionation unit to be separated into two fractions: an intermediate fraction that is not treated or optionally desulfurized without being mixed, and a heavy fraction that is optionally mixed with the heavy fraction that is obtained from (c) before being desulfurized in stage (f); or (iii) returned to fractionation (c), (f) a one stage desulfurization treatment of at least a portion of the heavy fraction that is obtained from the fractionation in (c).

16. A process according to claim 15 that also comprises (b) at least one transformation of the light sulfur-containing compounds that are present in the starting gasoline.

17. A process according to claim 16, in which stages a and b are carried out simultaneously in the same reactor.

18. A process according to claim 15, in which the gasoline that is obtained from stages a or b is fractionated into a light fraction, at least one intermediate fraction and a heavy fraction.

* * * * *

UNITED STATES PATENT AND TRADEMARK OFFICE

CERTIFICATE OF CORRECTION

PATENT NO. : 7,052,598 B2 
APPLICATION NO. : 10/095295
DATED : May 30, 2006
INVENTOR(S) : Quentin Debuisschert It is certified that error appears in the above-identified patent and that said Letters Patent is hereby corrected as shown below:

On Front Page, Add Inventors --David B. Arnett, League City, TX (US); Mike Grayson, Houston, TX (US); Donald E. Zeek, Dickinson, TX (US); Carl Snider, Houston, TX (US)--
Column 21, line 8 reads “line (b), at least”, should read -- ,line (b) at --
Column 21, line 9 reads “gasoline,(c), at” should read -- gasoline,(c) at --
Column 21, line 24 reads “desulfurized in stage (f); or” should read -- desulfurized in (f); or --
Column 21, line 26 reads “at least a portion at least” should read -- at least a portion of at least --
Column 21, line 28 reads “(f), a” should read -- (f) a --
Column 21, line 30 reads “(c) stage c” should read -- (c) --
Column 21, lines 33 & 34 reads “in which stage b and/or d makes” should read -- in which (b) makes --
Column 21, line 37 reads “from stages a or b is fractionated into alight”, should read -- from (a) and (b) is fractionated into a light --
Column 21, line 40 reads “comprising e for”, should read -- further comprising (e) --
Column 21, line 42 & 43 reads “in stage c or stage d”, should read -- in stage (c) or stage (d) --
Column 21, line 45 reads “in stage f”, should read -- in (f) --
Column 21, line 47 reads “claim 4 in which stage d for”, should read -- claim 1 in which (d) --
Column 21, line 51 reads “in stage f”, should read -- in (f) --
Column 21, line 54 reads “comprising a stage g for”, should read -- comprising a (g) --
Column 21, line 55 reads “stage c or d”, should read -- (c) or (d) --
Column 21, line 56 reads “from stage c or d or e”, should read --from (c) or (d) or (e) --
Column 21, line 57 reads “from stage f”, should read --from (f) --
Column 21, line 60 reads “that consists of”, should read -- consisting of --
Column 21, line 61 reads “(stage a)”, should read -- (a) --
Column 21, line 62 reads “(optional stage b)”, should read -- (b) --
Column 22, line 2 reads “(optional stage d)”, should read -- (d) --
Column 22, line 3 reads “fraction (optional stage e)”, should read -- fractions optional (e) r --
Column 22, line 4 reads “(stage f)”, should read -- (f) --
Column 22, line 7 reads “that consists”, should read -- consisting of --
Column 22, line 8 reads “(stage a)”, should read -- (a) --
Column 22, line 9 reads “(optional stage b)”, should read -- (b) --
Column 22, line 12 reads “(optional stage d)”, should -- (d) --
Column 22, line 13 reads “(optional stage 3)”, should read -- optional (e) --
Column 22, line 14 reads “(stage f)”, should read -- (f) --
Column 22, line 16 reads “stage d”, should read -- (d) --
Column 22, line 59 reads “stages a or b”, should read -- (b) --

UNITED STATES PATENT AND TRADEMARK OFFICE

CERTIFICATE OF CORRECTION

PATENT NO. : 7,052,598 B2
APPLICATION NO. : 10/095295
DATED : May 30, 2006
INVENTOR(S) : Quentin Debuisschert It is certified that error appears in the above-identified patent and that said Letters Patent is hereby corrected as shown below:

Column 22, line 18 reads “stage c”, should read -- (c) --
Column 22, line 20 reads “from stage d”, should read -- (d) --
Column 22, line 25 reads “stage c”, should read -- (c) --
Column 22, line 26 reads “stage f”, should read --(f) --
Column 22, line 29 reads “stage c”, should read -- (c) --
Column 22, line 29 reads “stage f”, should read -- (f) --
Column 22, line 56 & 57 reads “stages a and b”, should read -- “(a) and (b)” --
Column 22, line 59 reads “stages a or b”, should read --(b) --

Signed and Sealed this

Seventeenth Day of July, 2007

JON W. DUDAS
*Director of the United States Patent and Trademark Office*